US012024832B2

(12) United States Patent
Thelen

(10) Patent No.: US 12,024,832 B2
(45) Date of Patent: Jul. 2, 2024

(54) EXCHANGEABLE MILLING DRUM BOX UNIT, IN PARTICULAR QUICK-CHANGE MILLING DRUM BOX UNIT, AND GROUND MILLING MACHINE COMPRISING A BASE MACHINE AND AN EXCHANGEABLE MILLING DRUM BOX UNIT

(71) Applicant: BOMAG GmbH, Boppard (DE)

(72) Inventor: Thomas Thelen, Boppard (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 17/714,420

(22) Filed: Apr. 6, 2022

(65) Prior Publication Data

US 2022/0316334 A1 Oct. 6, 2022

(30) Foreign Application Priority Data

Apr. 6, 2021 (DE) ..... 102021001762.5
Jul. 28, 2021 (DE) ..... 102021119541.1

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC .... E01C 23/088; E01C 23/127; E02F 3/3604; E02F 3/3609; E02F 3/3645; E02F 3/3654; E02F 3/627; A01B 59/06; A01B 59/061
See application file for complete search history.

(56) References Cited

U.S. PATENT DOCUMENTS 5,299,857 A * 4/1994 Zanetis ..... E01C 23/088 404/90
5,316,347 A * 5/1994 Arosio ..... F16L 37/56 285/85

(Continued)

FOREIGN PATENT DOCUMENTS

DE 102014011856 A1 2/2016
DE 102015016678 A1 5/2017

(Continued)

OTHER PUBLICATIONS

European Patent Office, Extended European Search Report, Application No. 22163954.5, mailed Sep. 9, 2022 (6 pages).

(Continued)

*Primary Examiner* — Nicole Coy
*Assistant Examiner* — Michael A Goodwin
(74) *Attorney, Agent, or Firm* — Wood Herron & Evans LLP

(57) ABSTRACT

The present invention relates to a milling drum box unit, in particular a quick-change milling drum box unit, for mounting to a self-propelled base machine to obtain a ground milling machine, the milling drum box unit comprising a part of a fastening device for mounting the milling drum box unit to the base machine, a connection point configured to receive and establish a drive connection to a milling drum rotatable about a rotation axis, on sides of each side wall a lateral shield height-adjustable relative to the side wall, at least two drive energy-consuming consumer elements and/or at least two sensors for detecting an operating parameter.

10 Claims, 3 Drawing Sheets

(56) References Cited

U.S. PATENT DOCUMENTS

| | | | | |
|---|---|---|---|---|
| 5,957,213 | A * | 9/1999 | Loraas | E02F 3/96 37/302 |
| 2002/0189435 | A1* | 12/2002 | Domann | E02F 9/2275 91/459 |
| 2010/0131157 | A1* | 5/2010 | Kahle | E02F 3/3654 701/50 |
| 2016/0040371 | A1 | 2/2016 | Roetsch et al. | |
| 2017/0030033 | A1* | 2/2017 | Emme | E01C 23/088 |
| 2017/0130406 | A1 | 5/2017 | Steeg et al. | |
| 2017/0292649 | A1 | 10/2017 | Lubischer et al. | |
| 2020/0102720 | A1* | 4/2020 | Jelinek | E02F 9/2278 |
| 2020/0378075 | A1* | 12/2020 | Stinner | F16H 57/0417 |
| 2021/0332535 | A1* | 10/2021 | Winkels | E01C 23/088 |

FOREIGN PATENT DOCUMENTS

| | | | |
|---|---|---|---|
| DE | 102016004271 | A1 | 10/2017 |
| DE | 102020111311 | A1 | 10/2021 |

OTHER PUBLICATIONS

German Patent Office, Search Report, Application No. 102021119541.1, mailed Mar. 2, 2022 (4 pages).

European Patent Office, Search Report, Application No. 22163954.5, mailed Sep. 9, 2022 (6 pages).

* cited by examiner

Fig. 1
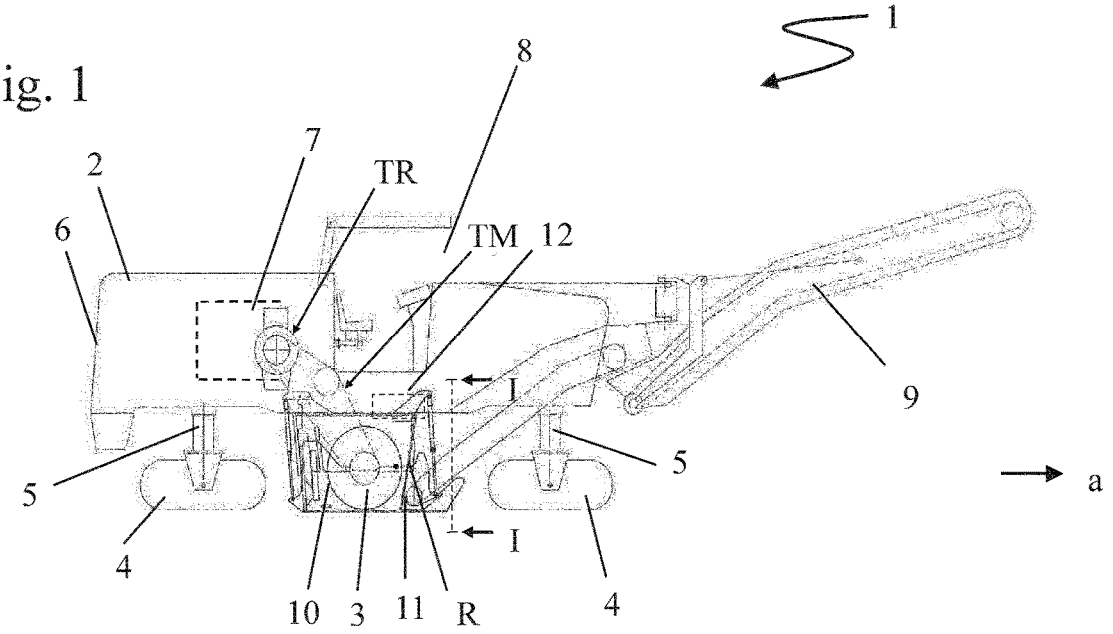
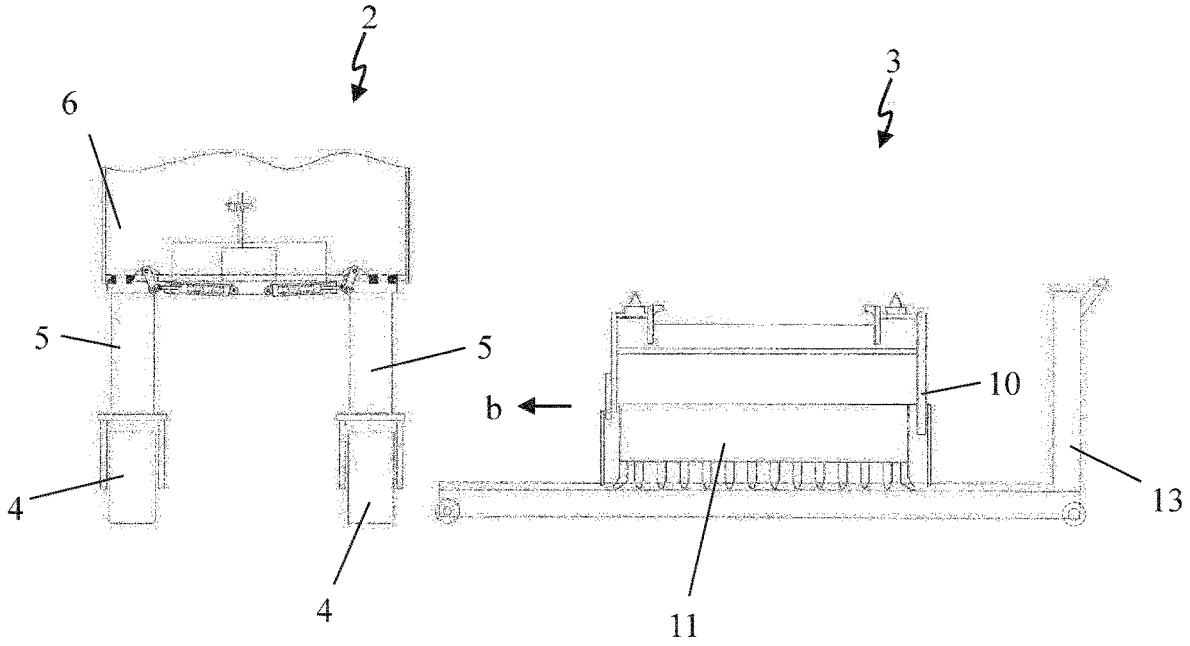
Fig. 2

EXCHANGEABLE MILLING DRUM BOX UNIT, IN PARTICULAR QUICK-CHANGE MILLING DRUM BOX UNIT, AND GROUND MILLING MACHINE COMPRISING A BASE MACHINE AND AN EXCHANGEABLE MILLING DRUM BOX UNIT

CROSS-REFERENCE TO RELATED APPLICATIONS

The present application claims priority under 35 U.S.C. § 119 of German Patent Application No. 10 2021 001 762.5, filed Apr. 6, 2021 and German Patent Application No. 10 2021 119 541.1, filed Jul. 28, 2021, the disclosures of which are hereby incorporated herein by reference in their entireties.

FIELD OF THE INVENTION

The present invention relates to a milling drum box unit, in particular a quick-change milling drum box unit, and a ground milling machine comprising a base machine and a milling drum box unit, in particular a quick-change milling drum box unit.

BACKGROUND OF THE INVENTION

Essential elements of a generic self-propelled ground milling machine are a machine part with a machine frame, an operator platform, a drive motor, and travel units driven by the drive motor, such as wheels and/or crawler tracks. The travel units are connected to the machine frame via lifting columns, so that the distance between the machine frame and the ground is adjustable in a vertical direction. This part of the ground milling machine is hereinafter also referred to as base machine. Further, a generic ground milling machine comprises a milling part, i.e., a milling drum box unit, in particular a quick-change milling drum box unit, with a milling drum for milling ground material and a milling drum box for covering the milling drum to the sides and to the top. The milling part can be detachably fastened via a fastening device that retains the milling drum box on the ground milling machine. In this regard, conventional fastenings are known in which the milling drum box unit is connected to the machine frame, for example, via several screw bolt connections that are comparatively complicated to release and difficult to access. Such fastenings are not suitable for routine mounting and dismounting of the milling drum box. Replacing such a milling drum box unit usually requires at least several hours and ideally a workshop environment. In order to simplify the mounting and dismounting of the milling drum box unit and thus, for example, also to give the operator of a ground milling machine the option to resort to different milling drum box units on site and/or to utilize milling drum box units with excess widths, so-called quick-change milling drum box units are also known. These are characterized by the fact that they allow comparatively simple and fast mounting and dismounting of the milling drum box unit on the machine. Such quick-change milling drum box units may often have one or more alignment devices, for example interacting inclined sliding surfaces and/or suspension swings, which in cooperation with the rest of the machine enable an exact relative alignment of the milling drum box unit to the rest of the machine for mounting the milling drum box unit, in particular by movement of the base machine relative to the quick-change milling drum box unit. Such ground milling machines with quick-change milling drum box units are known, for example, from DE102015016678A1. This is often not necessary with conventional systems.

An essential feature of these machines is thus their modular basic structure in that the milling unit is designed as a coherent module that is provided via the existing fastening device for, in the case of quick-change milling drum box units, comparatively fast dismounting and mounting on the base machine, for example in order to provide the customer with a desired milling drum box unit ex works or to quickly make the ground milling machine ready for use on construction sites. In other words, the ground milling machines relevant to the present case are characterized by the fact that the existing milling drum box units can be mounted and dismounted and, in particular in the case of quick-change milling drum box units, are designed and provided for regular mounting to and dismounting from the machine. For this purpose, either conventional detachable connections such as screw bolts or special fastening devices may be provided, which are to enable routine detachment of the quick-change milling drum box unit even in the field with comparably little effort.

Ground milling machines in which the milling drum box can be detached somehow, but only with a very high effort and, in particular, only with a high expenditure of time, do not fall under ground milling machines with a quick-change milling drum box unit. Generic ground milling machines with a quick-change milling drum box unit can therefore also be characterized, in particular, by the fact that at the interface between the quick-change milling drum box unit and the base machine, one or more devices are provided with the aid of which mutual alignment of the two components relative to one another is possible through mutual interaction.

Generic ground milling machines are normally used in road and pathway construction. Road milling machines of the cold road milling machine type are used, for example, to mill off a road surface for road resurfacing. The milling drum is usually supplied with drive energy by the drive unit of the ground milling machine, for example via a mechanical (in particular traction drives, such as belt or chain transmissions) or hydraulic drive train. The milling drum rotates within a milling drum box unit, in particular a quick-change milling drum box unit, about a horizontal rotation axis (when standing on a horizontal ground area) extending transverse to the working direction, and, in a state immersed in the ground, mills ground material. The milling drum box unit, in particular the quick-change milling drum box unit, thus also refers to a housing-like unit inside which the milling drum is arranged protruding toward the ground. The milling drum box prevents milled material from being thrown around in an uncontrolled manner during operation and also provides a compartment for controlled guidance of the milled material. The milling drum box unit, in particular quick-change milling drum box unit, which is open toward the ground, thus in other words partially surrounds the milling drum horizontally and vertically to the top. It is known to configure the milling part to be mountable/dismountable on the machine part of the ground milling machine as a whole, i.e., comprising the milling drum and the milling drum box unit. Dismounting of the milling part at a construction site may be desirable, for example, if the ground milling machine is to be made lighter, especially for transportation purposes. It will be appreciated that shortest possible working times are desired for dismounting and mounting of the milling part from/on the machine part, especially on the construction site. Moreover, there is often a need to be able to mill different milling widths with one and the same ground milling machine. To this end, it is preferred if different milling parts can be attached to one and the same ground milling machine and quickly exchanged. The possibility of dismounting the quick-change milling drum box unit as a whole from the machine part is described, for example, in DE102015016678A1.

In practical use, however, it has now been shown that the process of mounting and/or exchanging the milling drum box unit, in particular the quick-change milling drum box unit, on the base machine can still be optimized. In particular, measures going beyond the connection of the milling drum drive, such as the integration of consumers and/or sensors of the milling drum box unit, especially quick-change milling drum box unit, into the overall machine control system, represent a considerable effort. The same applies to the dismounting of the milling drum box unit, in particular quick-change milling drum box unit. Due to the given complexity, errors may also occur here. Irrespective of this, considerable hose lengths are usually required to integrate the milling drum box into the overall hydraulic machine drive system. The same applies to further cabling for sensors and/or electrical consumers on the milling drum box.

Against this background, one aspect of the present invention is to provide a way to further optimize the mounting and/or exchange of a milling drum box unit, in particular quick-change milling drum box unit, on a base machine and, in particular, to make it less error-prone.

SUMMARY OF THE INVENTION

One aspect of the present invention lies in a milling drum box unit, in particular quick-change milling drum box unit, for mounting to a self-propelled base machine to obtain a ground milling machine. The milling drum box unit, in particular quick-change milling drum box unit, comprises in one embodiment an interior configured to accommodate a milling drum and open downward in the vertical direction, with a front wall, a rear wall, a top wall and two opposing side walls. The entirety of these wall elements per se forms the so-called milling drum box, possibly supplemented by wall elements adjustable relative to the milling drum box, such as lateral shields. Further, part of a fastening device for mounting the milling drum box unit, in particular quick-change milling drum box unit, to the base machine is provided. This may include screw bolts, guide and/or arresting receptacles, but also adjustable and/or releasable arresting and/or locking elements. Such fastening devices are known per se in the prior art. The milling drum box unit, in particular quick-change milling drum box unit, further comprises in one embodiment a connection point arranged within the interior of the milling drum box unit, in particular quick-change milling drum box unit, which is designed to receive and establish a drive connection to a milling drum rotatable about a rotation axis. The connection point is thus essentially characterized by the fact that it is provided for receiving and transmitting drive energy which is to drive the rotational movement of the milling drum during milling operation. This may be done, for example, with the aid of a hydraulic or electric motor, but also mechanically, preferably with the aid of a traction drive. The milling drum box unit, in particular quick-change milling drum box unit, may further have gear elements, such as a reduction gear, etc., in the drive train toward the milling drum. The milling drum box unit, in particular quick-change milling drum box unit, further has a lateral shield on a side of each side wall, which is height-adjustable relative to the side wall. Seen in the direction of the rotation axis of the milling drum, the lateral shields are usually arranged on the outside with respect to the particular side wall. Finally, the milling drum box unit, in particular quick-change milling drum box unit, has at least two consumer elements consuming drive energy and/or at least two sensors for detecting an operating parameter, such as pressure, temperature, position, travel. The consumer elements referred to here are preferably not the milling drum, but consumers additionally included in the milling drum box unit, in particular quick-change milling drum box unit. These are ideally supplied with drive energy via the connection point described above, particularly preferably except during maintenance works.

According to the present invention, a distributing device or a connection device to a distributing device for hydraulic and/or electrical energy and/or incoming control signals is provided on the milling drum box unit, which performs a distribution of hydraulic and/or electrical energy and/or incoming control signals supplied via a common line to at least two hydraulic and/or electrical energy-consuming consumers and/or actuators of the milling drum box unit, in particular quick-change milling drum box unit, that can be controlled via control signals. This makes it possible to supply the milling drum box unit, in particular quick-change milling drum box unit, centrally, i.e., via a common line, with hydraulic and/or electrical energy (wherein a respective common line is obviously required here for each form of energy) and/or control and/or sensor signals and thus to transmit these centrally between the milling drum box unit, in particular quick-change milling drum box unit, and the base machine in the respectively required direction (electrical and/or hydraulic energy are usually supplied to the milling drum box unit, in particular quick-change milling drum box unit, from the base machine, hydraulic fluid may also be fed back; control signals are usually supplied to the milling drum box unit, in particular quick-change milling drum box unit, from the base machine; sensor signals/data may be supplied from the milling drum box unit, in particular quick-change milling drum box unit, to the base machine and/or vice versa). The distribution for the individual target points in or on the milling drum box unit, in particular quick-change milling drum box unit, then takes place only shortly before or close to the milling drum box unit, in particular quick-change milling drum box unit, or particularly preferably only in or on the milling drum box unit, in particular quick-change milling drum box unit, with the aid of one or more of the distributing devices.

The milling drum box unit, in particular quick-change milling drum box unit, may have a drive energy connection point configured for connection to a drive energy source external to the quick-change milling box unit, i.e., on the base machine side. Said connection point may, for example, be part of a suitable plug connection, in which case the complementary counterpart is arranged on the base machine side. Accordingly, the milling drum box unit, in particular quick-change milling drum box unit, does not generate the drive energy required for driving the at least two consumer elements within this module itself, but said drive energy is obtained from outside the milling drum box unit, in particular quick-change milling drum box unit, i.e., is obtained in a centralized or bundled form from the base machine in the mounted state. According to the present invention, a distributing device downstream of the connection point in the energy supply direction may also be comprised by the milling drum box unit, in particular quick-change milling drum box unit, or may be provided at least close to the milling drum box unit, in particular quick-change milling drum box unit, when mounted on the base machine, said distributing device being configured to distribute and allocate drive energy supplied via the drive energy connection point to the at least two consumer elements. With regard to the at least two consumers, the drive energy is thus supplied centrally to the milling drum box unit, in particular quick-change milling drum box unit.

However, according to the present invention, the distribution and supply of the drive energy to the at least two consumers is then carried out within the milling drum box unit, in particular quick-change milling drum box unit. This means that the connection point ideally only needs to have one supply line and usually only one return line per energy medium used, particularly preferably hydraulic energy (more specifically hydraulic fluid pressure generated by means of a hydraulic fluid) or electrical energy, so that the total number of connections to be disconnected and/or established with regard to supplying the milling drum box unit, in particular quick-change milling drum box unit, with drive energy is reduced to a minimum. This allows, for example, a type of "hydraulic bus system" to be implemented in the milling drum box unit, in particular quick-change milling drum box unit. Such a system is essentially characterized by the fact that hydraulic energy is supplied centrally to the milling drum box unit, in particular quick-change milling drum box unit. At least two hydraulic consumers on the side of the milling drum box unit, in particular quick-change milling drum box unit, then draw hydraulic energy from this hydraulic bus system, ideally as required. This means that no individual connection of these at least two consumers to a hydraulic supply of the base machine is required. In addition to the above-described, preferably single, drive energy connection point for hydraulic and/or electrical drive energy, a separate drive connection to a mechanical milling drum drive, such as a belt or chain drive, may also be provided.

Additionally or alternatively, the milling drum box unit, in particular quick-change milling drum box unit, may comprise a signal transmission point, ideally one single signal transmission point, configured for connection to a signal transmission system external to the milling drum box unit, in particular quick-change milling drum box unit, wherein the milling drum box unit, in particular quick-change milling drum box unit, may further comprise a control unit in signal connection with the at least two sensors and the signal connection point. This basic idea again follows the same solution concept. The number of connections to be established and/or disconnected with regard to the connection to the signal transmission system external to the milling drum box unit, in particular quick-change milling drum box unit, on the base machine can be reduced to a minimum.

It is ideal in one embodiment if the drive energy connection point and/or the signal transmission point are each configured as a single plug-in element or a plug-receiving element, or as a single plug-in element or a plug-receiving element in total. It will be appreciated that in this case a complementary mating counterpart is provided on the base machine for establishing a supply and/or transmission connection. The plug connection provided thus may comprise connecting parts on the milling drum box unit, in particular quick-change milling drum box unit, and the base machine that fit together positively. It is preferred if a positive and/or non-positive arresting device is additionally provided, for example by means of spring force, in order to prevent unintentional disconnection. As a further addition or alternative, in particular with regard to the transfer of hydraulic fluid, corresponding quick-coupling devices as described in the prior art may be used, especially of the type that automatically causes a line closure when the connection is released.

In a further embodiment of the present invention, in said single plug-in element, connectors on a supply and return line for hydraulic energy and/or connectors for electrical energy and/or connectors for signal transmission from the base machine to the milling drum box unit, in particular quick-change milling drum box unit, and/or vice versa are connected to each other in a common plug-in element. The connections produced via the plug-in element are thus no longer homogeneous across the plug-in element in terms of their transmitted energy form and/or function, but heterogeneous. Ideally, this means that the entire functional connection and disconnection of the milling drum box unit, in particular quick-change milling drum box unit, with regard to hydraulic and electrical energy supply and signal transmission can be combined in a single common plug-in element.

In particular, the present invention is directed to embodiments in which the at least two consumer elements consuming drive energy consume hydraulic or electrical energy. In this case, it is preferred that at least one of the two consumer elements, and preferably both, are hydraulically or electrically actuated linear actuators and/or hydraulically or electrically operated motors. Additionally or alternatively, the consumer elements are preferably configured such that they drive an adjusting movement of a lateral shield relative to a side wall and/or of a front flap adjustable relative to the front wall and/or of a stripper flap adjustable relative to the rear wall and/or of a hold-down device relative to the front wall and/or a rotational movement of the milling drum in maintenance operation.

There are also various embodiments with regard to the configuration of the distributing device. For example, the distributing device may be a distributing device for hydraulic energy. In this case, it is particularly preferred if the distributing device comprises a valve unit with at least two valves controllable between at least two switching positions, one of the valves in each case being assigned to one of the at least two consumer elements. The valve unit is thus supplied with hydraulic energy centrally from the base machine and supplies hydraulic energy to the respective hydraulic consumer via the controllable valves as required. The distribution and allocation of the hydraulic fluid for two or more hydraulic consumers of the milling drum box unit, in particular quick-change milling drum box unit, thus takes place on the side of the milling drum box unit, in particular quick-change milling drum box unit, and not on the base machine side. Ideally, the distributing device is configured as a compact valve block with at least two valve units and/or as a hydraulic BUS system. As a further addition or alternative, it is preferred in one embodiment if the distributing device has a single central drive energy supply line and a single central drive energy discharge line, especially when hydraulic drive energy is used. This means that not only the distribution of the incoming hydraulic fluid but also the collection of the returning hydraulic fluid is performed centrally via the distributing device, which enables a central hydraulic fluid return to the base machine. Typical hydraulic consumers of the milling drum box unit, in particular quick-change milling drum box unit, may be, for example, linear actuators for lifting adjustment of one or more lateral shields, for lifting adjustment of a scanning shoe for leveling, actuators for a belt shoe, a stripping plate, a front flap, etc.

With regard to the specific arrangement of the distributing device, it is preferred in one embodiment if the latter is arranged outside the milling drum box interior on the milling drum box unit, in particular quick-change milling drum box unit, in particular in a manner accessible from outside the milling drum box unit, in particular quick-change milling drum box unit, more particularly also in the state of the milling drum box unit, in particular quick-change milling drum box unit, mounted on the base machine. The advantages of the present invention become particularly apparent when the distributing device particularly may comprise all valves required for controlling hydraulically actuated work functions of the milling drum box unit, in particular quick-change milling drum box unit, very particularly within a single valve block.

If electrical drive energy is used instead of hydraulic drive energy, the arrangement concepts set out in the preceding and following paragraphs apply in an analogous manner for electrical drive energy. This means, in particular, that with regard to the necessary cabling, preferably only one central connection cable is required. Typical consumers of electrical energy at the milling drum box unit, in particular quick-change milling drum box unit, may be, for example, one or more sensors, illuminants for ambient lighting, actuators, etc.

Within the scope of the present invention, the milling drum box unit according to the present invention, in particular quick-change milling drum box unit, may also be varied with regard to the configuration of the at least two sensors. For example, it may be preferred that at least one of the at least two sensors has at least one of the following functions:

- it is a displacement transducer, in particular on or within a cylinder-piston unit, which monitors the adjusting movement of a linear actuator; this relates, in particular, to a cylinder-piston unit connecting the milling drum box to a lateral shield or the stripping plate or the hold-down device;
- it is a pressure sensor that monitors a fluid pressure of a cooling fluid and/or hydraulic fluid;
- it is a temperature sensor that monitors the temperature of an operating fluid;
- it is a closing sensor that monitors a flap position and/or a locking position of a locking element;
- it is an optical sensor, such as a camera, in particular;
- it is a non-contact distance sensor; and
- it is a position sensor.

It will be appreciated that in this case the corresponding sensors are also part of the milling drum box unit, in particular quick-change milling drum box unit, and in this manner no separate mounting/dismounting is required in the exchanging process.

With regard to the configuration of the control unit, it may be advantageous if it is in signal connection with the distributing device and controls the distributing device via the signal connection. The control unit can control all of the hydraulically or electrically driven work functions of the milling drum box unit, in particular quick-change milling drum box unit, if necessary taking into account control commands coming from the base machine, more specifically, for example, from the operator platform, and/or from an automatic function, such as for example an automatic leveling system. Additionally or alternatively, the control unit may also control at least one and, in particular, several ambient lights on the milling drum box unit, in particular quick-change milling drum box unit, in particular their activation and/or deactivation and/or dimming. Very specifically, the control unit may be configured as an electronic module (ECU). Additionally or alternatively, it is connected to the signal transmission point, which is configured, in particular, for connection to a CAN bus system on the machine side. The signal transmission may be wired or wireless. It is advantageous if the control unit of the milling drum box unit, in particular quick-change milling drum box unit, is configured to receive all sensor data of the milling drum box unit, in particular quick-change milling drum box unit, and/or for central signal communication via the signal transmission point.

With regard to the specific local positioning of the drive energy connection point and/or the signal transmission point on the remaining milling drum box unit, in particular quick-change milling drum box unit, it is advantageous if these are arranged at the top of the quick-change milling box unit and/or on a side wall of the milling drum box unit, in particular quick-change milling drum box unit. In this case, it may be advantageous if the two connection points are positioned at separate locations.

The milling drum box unit according to the present invention, in particular quick-change milling drum box unit, preferably further comprises in one embodiment a connection point for a mechanical drive gear for driving the milling drum, in particular comprising at least one traction roller "TR" for integration into a traction drive for driving the milling drum, the drive energy connection point and/or the signal transmission point and/or the distributing device and/or the control unit being arranged on the milling drum box unit, in particular quick-change milling drum box unit, in the region to be circled by the traction means. This enables particularly efficient use of installation space and thus a particularly compact overall configuration of the milling drum box unit, in particular quick-change milling drum box unit.

The milling drum box unit, in particular quick-change milling drum box unit, may comprise a connection device for connection to an on-board electrical system of the base machine, in particular for supplying one or more ambient lights of the milling drum box unit, in particular quick-change milling drum box unit.

It is preferred in one embodiment if the exchangeable milling drum box unit has a housing part for enclosing the traction roller, in particular comprising a removable, especially pivotable, side flap. In this manner, the exchanging process is further facilitated. The side flap allows particularly efficient access to the inner region on the milling drum box unit, in particular quick-change milling drum box unit, circled by the traction means, which is particularly advantageous if the drive energy connection point and/or the signal transmission point and/or the distributing device and/or the control unit are arranged in this region.

Another aspect of the present invention relates to a ground milling machine, comprising a base machine with a machine frame, an operator platform, a drive motor, such as a diesel combustion engine, as well as travel units driven by the drive motor, for example wheels or crawler tracks. The ground milling machine further comprises a milling drum box unit, in particular quick-change milling drum box unit, with a milling drum for milling ground material, and a detachable, in particular hydraulically, electrically, electromechanically or pneumatically detachable, fastening device with which and/or via which the milling drum box unit, in particular quick-change milling drum box unit, can be detachably fastened to the base machine of the ground milling machine. In particular, the present invention relates to a ground milling machine of the center rotor type, the essential feature of which is that the milling drum box unit, in particular quick-change milling drum box unit, is arranged between one or more front and rear travel units, as seen in the forward travel direction of the ground milling machine.

In this case, the aspect is achieved by the milling drum box unit, in particular quick-change milling drum box unit, being configured in accordance with the present invention and the base machine having, in particular, a detachable mating connector for connection to the drive energy connection point and/or the signal transmission point of the milling drum box unit, in particular quick-change milling drum box unit. This enables the milling drum box unit, in particular quick-change milling drum box unit, to be supplied with energy from the base machine in a particularly efficient manner. Additionally or alternatively, this enables particularly efficient signal or information communication between the machine and the milling drum box unit, in particular quick-change milling drum box unit. Alternatively, the distributing device may be arranged on the base machine, but then close to the milling drum box unit, in particular quick-change milling drum box unit, in order to keep the connection paths as short as possible. The connector and the mating connector are preferably configured in one embodiment as a plug connection, ideally with at least one additional arresting device that mechanically secures the connector plugged into the mating connector. In addition, a monitoring device may be provided, for example in the form of a contact switch that can be actuated by the connector or mating connector, with which the intact plug connection between these two elements is monitored.

For the ground milling machine according to the present invention, it is preferred in one embodiment if the base machine has a housing part for enclosing a traction roller or traction sprocket, in particular of the belt or chain transmission described above, wherein, in particular, the detachable mating connector for the drive energy connection point and/or the signal transmission point is arranged in a region within the housing circled by the traction means. Additionally or alternatively, the housing part has a connector complementary to the housing part of the milling drum box unit, in particular quick-change milling drum box unit. The housing provided for the traction drive for driving the milling drum is thus only complete when the milling drum box unit, in particular quick-change milling drum box unit, and the base machine are combined.

BRIEF DESCRIPTION OF THE DRAWINGS

The present invention will be described in more detail below based on the embodiment examples illustrated in the figures. In the schematic figures:

FIG. 1 is a side view of a ground milling machine of the center rotor type with a base machine and a milling drum box unit, in particular quick-change milling drum box unit;

FIG. 2 shows a view of the disassembled state of the ground milling machine and the milling drum box unit, in particular quick-change milling drum box unit;

Like components are designated by like reference numerals in the figures, although recurring components may not be designated separately throughout the figures.

DETAILED DESCRIPTION OF THE INVENTION

Figure 3:
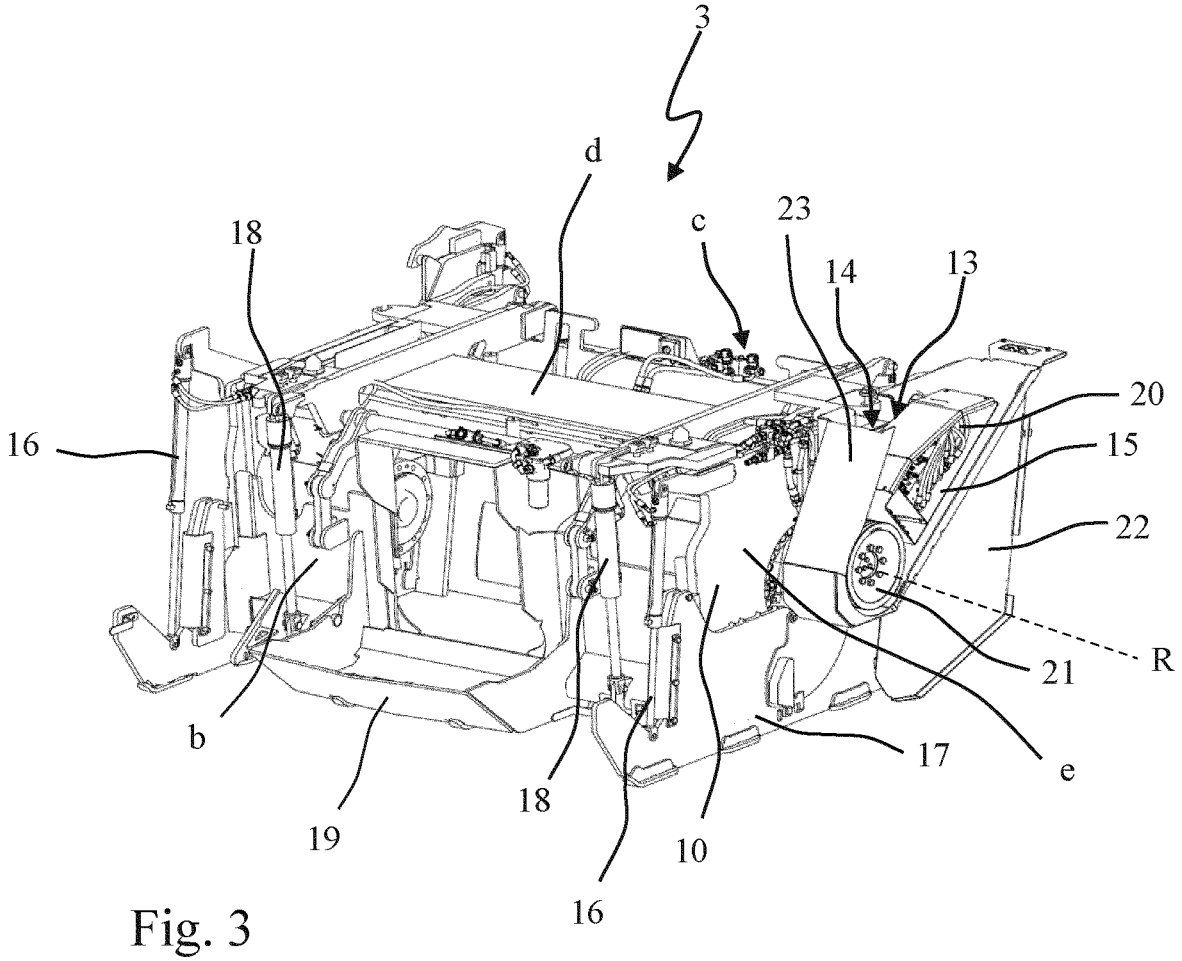
FIG. 3 is an oblique perspective view of a milling drum box unit, in particular quick-change milling drum box unit.

FIG. 1 shows a generic self-propelled ground milling machine 1, in this case a cold road milling machine. More specifically, it is a large milling machine of the center rotor type. Elements of the ground milling machine include a machine part 2 or a base machine and a milling part 3 in the form of a milling drum box unit, in particular quick-change milling drum box unit. The base machine 2 comprises a machine frame 6, which is height-adjustably supported by travel units 4 via lifting columns 5, with a drive motor 7, an operator platform 8 and a milled material conveyor 9. The lifting columns 5 enable height adjustment of the machine frame 6 in vertical direction relative to the ground. The drive motor 7 supplies the drive energy required for the milling and transport operation, in particular for the travel drive and the drive of the milling device, which is described in more detail below. From the operator platform 8, the ground milling machine 1 is operated by an operator during working operation. During working operation, the ground milling machine 1 travels over the ground to be worked in working direction a and mills a material to be milled. Specifically, this is done with the milling drum box unit, in particular quick-change milling drum box unit, 3, comprising a milling drum box 10 and a milling drum 11 arranged in the interior of the milling drum box 10. The milling drum box 10 in total comprises a front wall b, a rear wall c, a cover d toward the top located above the milling drum 11 and covers e to the left and right sides (shown in FIG. 3). The milling drum box 10 is open toward the ground, so that the milling drum 11 positioned inside the milling drum box 10 can engage the ground from within the milling drum box 10. For milling operation, the milling drum 11 rotates about a horizontal rotation axis R extending transversely to the working direction a.

The milling part 3 is configured as a modular unit that can be dismounted from the machine part 2 of the ground milling machine 1. To this end, a fastening device 12, which is shown only in highly schematized form in FIG. 1, is provided for connecting the milling part 3 to the machine part 2. The possible structure and the possible mode of operation of this fastening device 12 per se are known in the prior art, for example described in DE102015016678A1. It will be appreciated that for mounting/dismounting the milling drum box unit, in particular quick-change milling drum box unit 3, the drive train, which in the present embodiment is partially configured as a belt drive, must be separated and restored after the milling drum box unit, in particular quick-change milling drum box unit 3, has been installed.

FIG. 2 shows the state prior to the installation of the dismounted milling drum box unit, in particular quick-change milling drum box unit 3, with the milled material conveyor removed before installation of the milling drum box unit, in particular quick-change milling drum box unit 3, on the machine part 2, as seen in the direction of the arrows toward the section line Hof FIG. 1. For this purpose, the milling drum box unit, in particular quick-change milling drum box unit 3, is pushed, for example, in the present embodiment example via a suitable transport device (for example a trolley) 13, in direction b from a position located laterally next to the base machine 2 transversely to the working direction a below the machine part 2 between the front and rear travel units 4. The specific procedure may be varied. The machine frame 6 is in this case moved upward in vertical direction via the lifting columns 5, so that there is sufficient space below the machine frame 6 of the machine part 2. Once the milling drum box unit, in particular quick-change milling drum box unit 3, and the base machine 2 are aligned to each other accordingly, both modules can be connected to each other.

The special features of the milling drum box unit, in particular quick-change milling drum box unit 3, are illustrated in more detail in FIG. 3. Accordingly, part of the milling drum box unit, in particular quick-change milling drum box unit 3, may be a drive energy connection point 13 and a signal transmission point 14, via which a functional connection to the base machine 2 is made with regard to drive energy and/or signal transmission. In the present case, the drive energy connection point 13 is a connector with a hydraulic fluid supply opening and a hydraulic fluid return opening (not shown in the figures), via which hydraulic fluid can be centrally supplied from the base machine 2 to the milling drum box unit, in particular quick-change milling drum box unit 3, and returned from the milling drum box unit, in particular quick-change milling drum box unit 3, to the base machine 2. In a corresponding manner, the signal transmission point 14 is configured to transmit sensor data and control signals. In particular, it may be a CAN bus connection point. Additionally or alternatively, electrical energy may also be transmitted centrally via a central connection point. The connection point may also be configured for combined transmission of hydraulic energy and/or electrical energy and/or sensor signals and/or control signals.

The milling drum box unit, in particular quick-change milling drum box unit 3, further comprises a distributing device 15 configured as a valve block. The valve block centrally supplies the hydraulic fluid coming from the base machine 2 via the drive energy connection point 13 to individual hydraulic consumers of the milling drum box unit, in particular quick-change milling drum box unit 3. Specifically, these may be, for example, linear actuators 16 for lifting adjustment of lateral shields 17, linear actuators 18 for height adjustment of a hold-down device 19, linear actuators for lifting and/or pivoting adjustment of a rear stripper flap and/or a hydraulic maintenance motor for driving a slow rotational movement of the milling drum (not shown in FIG. 3), for example during the exchange of chisels. These linear actuators may be adjustable individually and/or in pairs and/or in groups. The supply and return lines of the individual linear actuators converge centrally at the distributing device.

To control the individual hydraulic consumers, the milling drum box unit, in particular quick-change milling drum box unit 3, comprises a control unit 20 in the form of an electronic module which is in signal or control connection, in particular also with the valve block. The control unit is further connected to the signal transmission point 14 for communication with the base machine 2. Other consumers, such as an ambient light, distance sensors, a camera, etc., may also be connected to the control unit for control and/or signal processing and/or signal forwarding to the base machine 2, and may be controlled by the latter. Further, a further connection point not shown separately in FIG. 3 may be provided by the milling drum box unit, in particular quick-change milling drum box unit 3, for connection to the on-board electrical system of the base machine 2, i.e., for transmission of electrical energy.

The control unit 20 may further be in signal communication with a plurality of sensors. Specifically, these may be, for example, displacement measuring devices arranged on or within the linear actuators described above, pressure sensors arranged within one or more hydraulic lines, temperature sensors for determining the temperature of an operating fluid, etc. The control unit 20 combines the incoming sensor data and transmits them, preferably via the CAN bus system, centrally to the base machine 2.

The drive energy connection point 13 and the signal transmission point 14 may be part of a plug connection with complementary mating elements provided on the base machine 2. The established plug connection can be secured by means of an arresting device and/or monitored by means of a monitoring device.

Finally, the milling drum box unit, in particular quick-change milling drum box unit 3, comprises a connection point 21 for a mechanical drive gear, in this case in the form of a traction drive, as described above with respect to FIGS. 1 and 2. In FIG. 3, the connection point 21 is specifically configured as a belt roller as an example. In the present embodiment example, the space circled by the traction means "TM" in the assembled state of the milling drum box unit, in particular quick-change milling drum box unit 3, serves, in particular, to accommodate elements 13, 14, 15 and 20. This interior may be closed off and protected from the outside with a cover plate 22. The cover plate 22 is part of a gear housing half 23 configured to enclose the gear components of the drive gear for the milling drum located on the side of the milling drum box unit, in particular quick-change milling drum box unit 3, when the milling drum box unit, in particular quick-change milling drum box unit 3, is mounted on the base machine 2. This gear housing half 23 is completed in the mounted state of the milling drum box unit, in particular quick-change milling drum box unit 3, on the base machine 2 by a corresponding further gear housing half mounted on the base machine 2.

Figure 4:
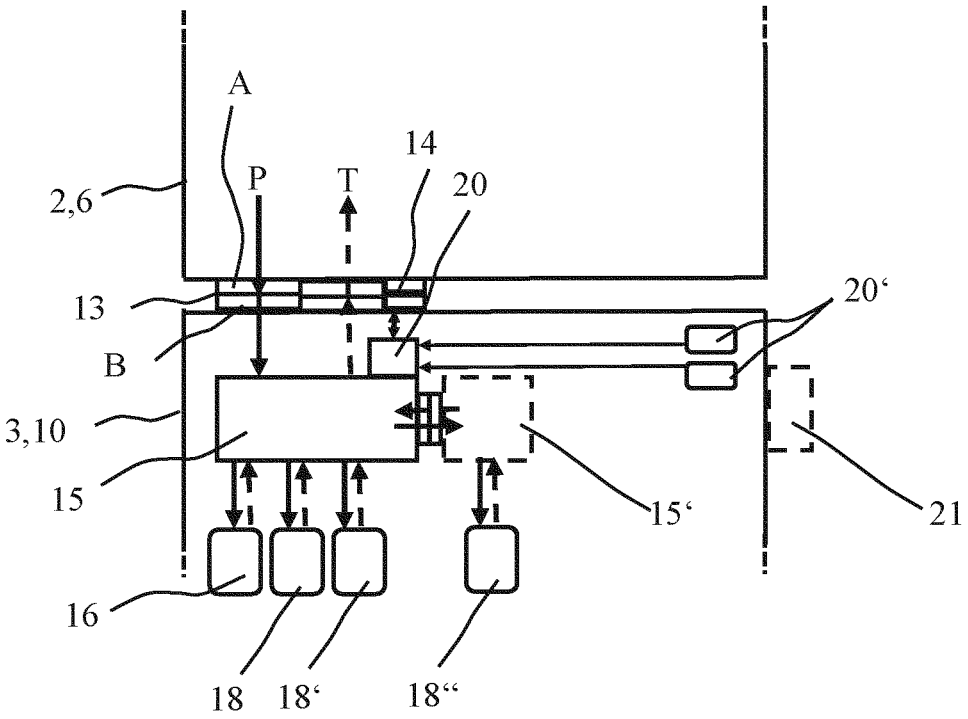
FIG. 4 is a schematic view of the supply principle of a milling drum box unit, in particular quick-change milling drum box unit, according to the present invention.

Finally, FIG. 4 illustrates the supply principle of a milling drum box unit, in particular quick-change milling drum box unit 3, according to the present invention, especially as described in the previous figures. The individual components are for the most part described with respect to the preceding figures, so that reference is made here to the corresponding use of the reference numerals. FIG. 4 now illustrates once again the "tapping principle" of the configuration of a milling drum box unit, in particular quick-change milling drum box unit 3, according to the present invention. For example, the hydraulic supply from the base machine 2 to the milling drum box unit, in particular quick-change milling drum box unit 3, takes place centrally via the connection point 13 (with the high-pressure side P for supplying the unit 3 and the low-pressure side T for returning hydraulic fluid from the unit 3 to the base machine 2). The connection point 13 thus has only two connected lines. The distribution to the individual consumers 16, 18, 18', on the other hand, only takes place in the domain of unit 3, so that the milling drum box unit, in particular quick-change milling drum box unit 3, thus only requires two line connections in the hydraulic system (hydraulic supply P and return T) toward the base machine 2. Optionally, further distribution blocks 15' may be connected to the central distribution block 15, for example to supply individual equipment options 18" with hydraulic energy. This may thus also be done via the central "tapping point" 15 and thus via said one connection 13 to the base machine. This means that the individualization of the hydraulic system and/or the distribution of the hydraulic energy preferably only takes place on the side of the milling drum box unit, in particular quick-change milling drum box unit 3, and not already on the side of the base machine. Such an equipment option may be, for example, the scanning device of a leveling system, a hydraulic maintenance motor for driving a slow rotational movement of the milling drum, or the like.

The control unit 20 may be in signal communication with the distribution device 15, for example to switch valves in the distribution device such that they supply hydraulic energy to various consumers as needed.

The connection point 14 may be used to transmit signals and/or electrical energy between the base machine 2 and the milling drum box unit, in particular quick-change milling drum box unit 3. Further, the control unit 20 may be in energy transmission and/or signal communication with one or more sensors 20'.

FIG. 4 further illustrates schematically that the connection points 13 and/or 14 (these may also be contiguous) are configured as a plug connection with a plug half A on the side of the base machine 2 and a plug half B on the side of the milling drum box unit, in particular quick-change milling drum box unit 3. The two plug halves are at least partially complementary to each other in the contact region and may also include, for example, leakage protectors, quick couplings, etc. The two plug halves A and B may be additionally secured in the plugged state by an arresting device and/or the established plugged state may be monitored by a monitoring device, for example by a contact switch or the like actuated by the plug half B on the plug half A. The arresting device and/or the monitoring device may transmit sensor data to a machine control system and, for example, reduce and/or switch off machine functions if the plug connection is released during operation, and/or prevent them if the plug connection is not established.

Within the scope of the present invention, the distribution block may also be positioned on the base machine 2, but then in the immediate vicinity of the milling drum box unit, in particular quick-change milling drum box unit 3, i.e., in particular on the bottom side of the base machine facing the milling drum box unit, in particular quick-change milling drum box unit 3, in the mounted state of the milling drum box unit, in particular quick-change milling drum box unit 3, and/or in a bottom edge region of this bottom side. In this case, the milling drum box unit, in particular quick-change milling drum box unit 3, comprises one or more connection devices for establishing at least one supply connection for hydraulic and/or electrical energy and/or a sensor and/or control signal transmission connection to the distributing device on the side of the base machine. In accordance with the above explanations, these may, for example, be configured analogously to the connection points 13 and/or 14. Mixed forms of these two variants are also possible, in which case a respective distributor device is then arranged on the milling drum box unit, in particular quick-change milling drum box unit 3, and a further distributing device is arranged on the base machine 2, in particular in the preferred region described above.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A ground milling machine, comprising:

a base machine with a machine frame, an operator platform, a drive motor and travel units driven by the drive motor;

a milling drum box unit with a milling drum for milling ground material, said milling drum box unit comprising:

an interior configured to accommodate the milling drum and open downward in vertical direction, with a front wall, a rear wall, a top wall and two opposing side walls;

a detachable fastening device with which the milling drum box unit can be detachably fastened to the base machine of the ground milling machine, a connection point arranged within the interior of the milling drum box unit which is configured to receive and establish a drive connection to the milling drum rotatable about a rotation axis;

a drive energy connection point configured for connection to a drive energy source external to the milling drum box unit, wherein the drive energy connection point is configured as a single plug-in element or a plug-in receiving element;

a complimentary mating counterpart to the single plug-in element or the plug-in receiving element provided on the base machine for establishing a supply connection;

a distributing device or a connection device to a distributing device for hydraulic energy provided on the milling drum box unit, which performs a distribution of hydraulic energy supplied via a common line to at least two hydraulic energy-consuming consumers;

quick coupling devices that automatically cause a line closure when the connection of the drive energy connection point and the drive energy source is released;

a positive and/or non-positive arresting device configured to prevent unintentional disconnection of the single plug-in element or the plug-in receiving element and the complimentary mating counterpart to the single plug-in element or the plug-in receiving element; and on sides of each side wall, a lateral shield which is height-adjustable relative to the side wall, wherein the connection point further comprises a mechanical drive gear for driving the milling drum, comprising at least one traction roller for integration into a traction drive for driving the milling drum, and further wherein the distributing device and/or a control unit configured as an electronic module is arranged on the milling drum box unit in a region to be circled by a traction means.

2. The ground milling machine according to claim 1, wherein the distributing device downstream of the drive energy connection point in an energy supply direction further being configured for distributing and allocating drive energy supplied via the drive energy connection point to the at least two hydraulic energy-consuming consumers, and/or the distributing device has a signal transmission point configured for connection to a signal transmission system external to the milling drum box unit, the control unit being in signal communication with the at least two sensors and a signal connection point, and/or the distributing device has a connector to a CAN bus system of a machine control system of the ground milling machine, wherein signal transmission connections to the at least two sensors originate from this connector.

3. The ground milling machine according to claim 1, wherein the at least two hydraulic energy-consuming consumers consuming hydraulic energy and include at least one of the following features:

the at least two hydraulic energy-consuming consumers are hydraulically actuated linear actuators;

the at least two hydraulic energy-consuming consumers are hydraulically operated motors; and the at least two hydraulic energy-consuming consumers are configured such that the at least two hydraulic energy-consuming consumers drive an adjusting movement of the lateral shield relative to a side wall and/or of a front flap adjustable relative to the front wall and/or of a stripper flap adjustable relative to the rear wall and/or of a hold-down device relative to the front wall.

4. The ground milling machine according to claim 1, wherein the distributing device includes at least one of the following features:

the distributing device is a distribution device for hydraulic energy and comprises a valve unit with at least two valves controllable between at least two switching positions, one of the valves in each case being assigned to one of the at least two hydraulic energy-consuming consumer elements;

the distributing device is configured as a valve block with at least two valve units;

the distributing device comprises a drive energy supply line and a drive energy discharge line;

the distributing device is arranged outside the milling drum box interior on the milling drum box unit; and the distributing device comprises all valves required to control hydraulically actuated work functions of the milling drum box unit.

5. The ground milling machine according to claim 1, wherein at least one of the at least two sensors has at least one of the following functions:

the at least one of the at least two sensors is a displacement transducer which monitors an adjusting movement of a linear actuator;

the at least one of the at least two sensors is a pressure sensor that monitors a fluid pressure of a cooling fluid and/or hydraulic fluid;

the at least one of the at least two sensors is a temperature sensor that monitors a temperature of an operating fluid;

the at least one of the at least two sensors is a closing sensor that monitors a flap position and/or a locking position of a locking element;

the at least one of the at least two sensors is an optical sensor; and the at least one of the at least two sensors is a non-contact distance sensor.

6. The ground milling machine according to claim 1, wherein the control unit fulfills at least one of the following features:

the control unit is in signal communication with the distributing device and controls the distributing device;

the control unit controls all hydraulically driven work functions of the milling drum box unit;

the control unit controls at least one ambient light;

the control unit is connected to a signal transmission point, which is configured for connection to a CAN bus system on a machine side; and the control unit is configured to receive all sensor data of the milling drum box unit and/or for signal communication via the signal transmission point.

7. The ground milling machine according to claim 1, wherein the drive energy connection point and/or a signal transmission point:

are arranged on the top wall of the milling drum box unit; and/or are arranged on a side wall of the milling drum box unit.

8. The ground milling machine according to claim 1, wherein the milling drum box unit comprises a connection device for connection to an on-board electrical system of the base machine, for supplying one or more ambient lights of the milling drum box unit.

9. The milling drum box unit according to claim 8, wherein the milling drum box unit has a housing part for enclosing the traction roller, comprising a removable, or pivotable side flap.

10. The ground milling machine according to claim 1, wherein the distributing device or the connection device to the distributing device is provided on the milling drum box unit, which also performs distribution of electrical energy and/or incoming control signals.

* * * * *